US010487787B2

(12) United States Patent
Martin

(10) Patent No.: US 10,487,787 B2
(45) Date of Patent: Nov. 26, 2019

(54) INJECTOR TIP FOR A FUEL INJECTOR

(71) Applicant: Caterpillar Inc., Peoria, IL (US)

(72) Inventor: Glen Clifford Martin, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 15/628,220

(22) Filed: Jun. 20, 2017

(65) Prior Publication Data

US 2018/0363614 A1 Dec. 20, 2018

(51) Int. Cl.
*F02M 61/18* (2006.01)
*F02M 61/10* (2006.01)

(52) U.S. Cl.
CPC ..... *F02M 61/1806* (2013.01); *F02M 61/10* (2013.01); *F02M 61/1893* (2013.01)

(58) Field of Classification Search
CPC ..... F02M 61/1893; F02M 61/1886; F02M 61/188; F02M 61/1873
USPC ..... 239/533.12; 251/328
See application file for complete search history.

(56) References Cited

U.S. PATENT DOCUMENTS 5,221,046 A 6/1993 Timmer
5,484,108 A 1/1996 Nally
5,516,047 A * 5/1996 Kubach ..... F02M 51/0671 239/585.1
6,360,960 B1 3/2002 Nally, Jr. et al.
6,439,483 B2 * 8/2002 Meyer ..... F02M 45/00 239/533.11
8,919,677 B2 12/2014 Soteriou et al.
2006/0097080 A1 * 5/2006 Goenka ..... F02M 61/1806 239/533.12
2006/0231065 A1 * 10/2006 Pontoppidan ..... F02M 61/1806 123/305
2011/0163187 A1 * 7/2011 Heyse ..... F02M 61/1853 239/533.12
2014/0190451 A1 * 7/2014 Vorbach ..... F02M 61/06 123/445

FOREIGN PATENT DOCUMENTS

DE 102006056842 A1 * 6/2008 ..... F02M 51/0603
WO 9219859 11/1992

* cited by examiner

*Primary Examiner* — Jason J Boeckmann
(74) *Attorney, Agent, or Firm* — Oblon, McClelland, Maier & Neustadt

(57) ABSTRACT

An injector tip for a fuel injector includes an exterior surface, and an interior surface defining a sac region therein. The injector tip is also configured to define at least one orifice radially extending from the interior surface to the exterior surface. The orifice is disposed in communication with the sac region located adjacent to the interior surface. Further, the injector tip also includes a mound that is defined on the interior surface such that the mound is integrally formed with the interior surface adjacent to the sac region. The mound is configured to extend along an axis of the sac region and terminate prior to a perimeter of the at least one orifice.

16 Claims, 4 Drawing Sheets

INJECTOR TIP FOR A FUEL INJECTOR

TECHNICAL FIELD

The present disclosure relates to a fuel injector. More particularly, the present disclosure relates to an injector tip for a fuel injector having a reduced possibility of fuel dribble during and upon completion of a fuel discharge event.

BACKGROUND

Fuel injectors are used to deliver fuel to a combustion chamber of an engine. In many cases, these fuel injectors have high fuel pressure within that would be provided from a pump and rail arrangement located upstream of the fuel injectors. This high pressure of the fuel combined with an inter-relative geometry of a sac region and a needle tip of the fuel injector may influence one or more parameters associated with discharge and combustion of the fuel. These parameters in turn, affect the quality of emissions before being released into the atmosphere. For instance, during a fuel discharge event, many conventional fuel injectors have been known to dribble fuel to at least about a droplet size from their sac regions into the combustion chamber of the engine. This could lead to undesired effects including, amongst other things, the presence of unburned hydrocarbons in the emissions released by the combustion chamber.

Many strategies have been developed to reduce this dribble effect so that the quality of emissions from combustion chambers of an engine can be improved. One such strategy is disclosed in PCT Publication WO 1992/019859 (hereinafter referred to as 'the '859 publication'). The '859 publication discloses a fuel injection nozzle having a nozzle body in which is formed a bore having a seating defined at one end. A valve member is movable in the bore and is shaped to cooperate with the seating to control fuel flow into a sac volume defined by a blind drilling formed in the body. Outlet orifices extend to an exterior of the body from the drilling and in order to reduce the volume of the sac volume an insert is positioned in the drilling. However, this insert may be displaceable in position when subject to extreme working pressures typically encountered in fuel injection nozzles. Moreover, due to a possibility of displacement in position of the insert, the body, and in particular, the sac region of the injection nozzle may be subject to collisions or abrasion from the insert thereby reducing a service life of the injection nozzle.

Hence, there is a need for a fuel injector having a sac region that is capable of withstanding high operational forces while also being configured to minimize fuel dribble from occurring during or after a fuel discharge event.

SUMMARY OF THE DISCLOSURE

In an aspect of the present disclosure, an injector tip for a fuel injector includes an exterior surface, and an interior surface defining a sac region therein. The injector tip is also configured to define at least one orifice radially extending from the interior surface to the exterior surface. The orifice is disposed in communication with the sac region located adjacent to the interior surface. Further, the injector tip also includes a mound that is defined on the interior surface such that the mound is integrally formed with the interior surface adjacent to the sac region. The mound is configured to extend along an axis of the sac region and terminate prior to a perimeter of the at least one orifice. In aspects of this disclosure, the mound is convex in shape.

In another aspect of this disclosure, ends of the mound may terminate tangentially with respect to the perimeter of the at least one orifice. Optionally, a concave ridge portion could be disposed between the mound and the at least one orifice.

In yet another aspect of this disclosure, a fuel injector includes a body having an injector tip according to the present disclosure.

In yet another aspect of this disclosure, claims have been directed to an engine having a combustion chamber, and the fuel injector of the present disclosure partially received in the combustion chamber to deliver a pressurized supply of fuel into the combustion chamber.

Other features and aspects of this disclosure will be apparent from the following description and the accompanying drawings.

DETAILED DESCRIPTION

Figure 1:
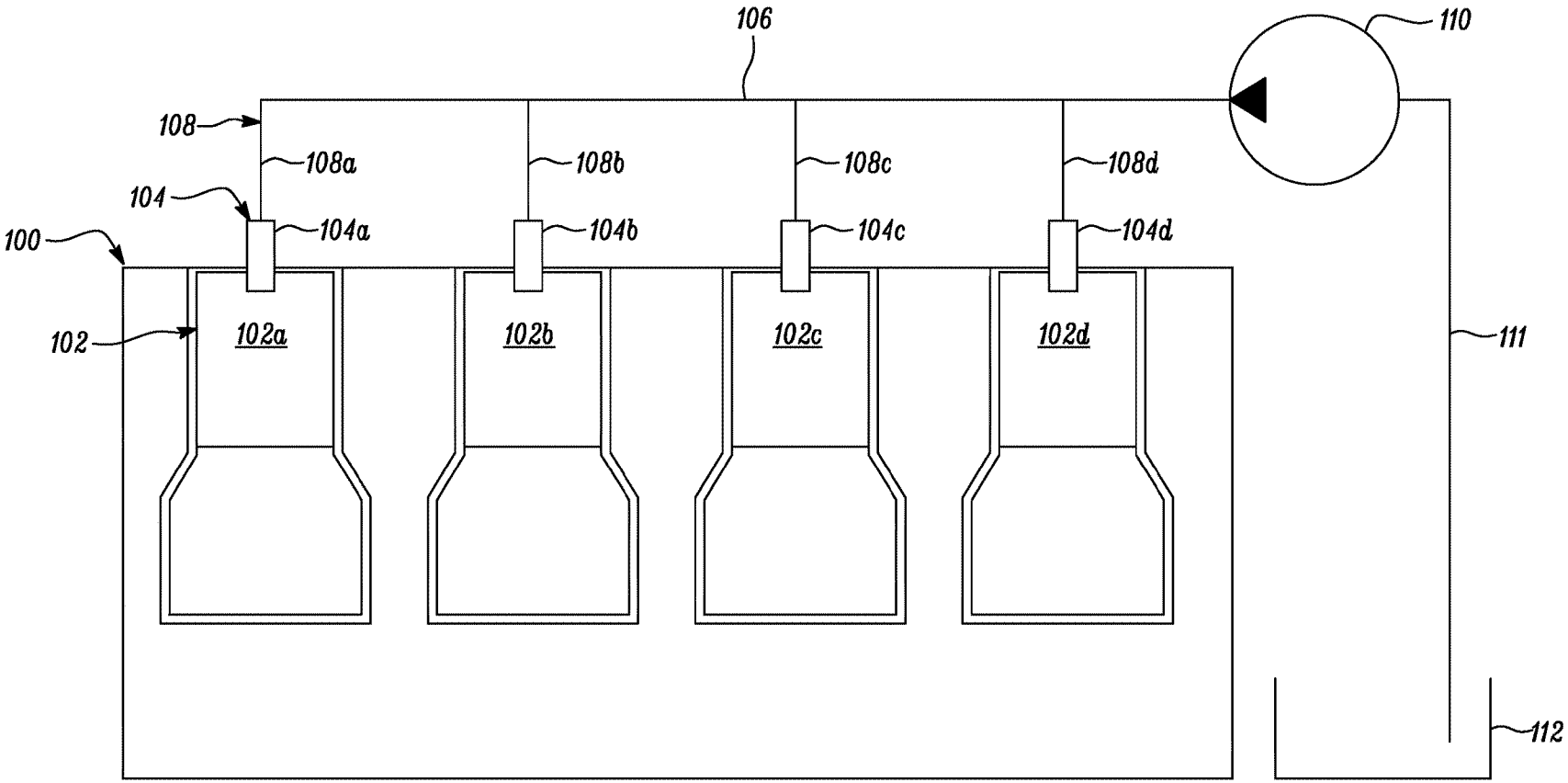
FIG. 1 is a diagrammatic view of an exemplary engine showing multiple combustion chambers and a fuel injector associated with each of the combustion chambers, in accordance with an embodiment of the present disclosure.

Reference numerals appearing in more than one figure indicate the same or corresponding parts in each of them. References to elements in the singular may also be construed to relate to the plural and vice-versa without limiting the scope of the disclosure to the exact number or type of such elements unless set forth explicitly in the appended claims.

FIG. 1 illustrates an exemplary engine 100, in accordance with an embodiment of the present disclosure. As shown, the engine 100 is embodied as an internal combustion diesel engine of the reciprocating type. In other embodiments, the engine 100 could include, a natural gas direct injection engine, or other types of engine configurations known to persons skilled in the art.

Referring to FIG. 1, the engine 100 includes four combustion chambers 102, which are individually denoted with alpha-numerals 102*a*-102*d*. Each of these combustion chambers 102 is provided with a fuel injector 104. Although four combustion chambers 102*a*-102*d* are shown in the illustrated exemplary engine 100 of FIG. 1, in other embodiments, fewer or more combustion chambers 102 may be included in the engine 100 depending on specific requirements of an application. For example, a single cylinder engine may be contemplated for use in lieu of the multi-cylinder engine 100 depicted in the illustrated embodiment of FIG. 1.

Moreover, although a single fuel injector 104 is shown associated with each of the combustion chambers 102*a*-102*d* in the exemplary engine 100 of FIG. 1, in other embodiments, more than one fuel injector 104 may be associated with each combustion chamber 102 of the engine 100. Therefore, a number of combustion chambers 102 and a number of fuel injectors 104 used with each combustion chamber 102 is merely exemplary in nature, and hence non-limiting of this disclosure. Persons skilled in the art will acknowledge that the number of combustion chambers 102 and the number of fuel injectors 104 used with each combustion chamber 102 may vary depending upon specific requirements of an application.

Each of the fuel injectors 104*a*-104*d* is disposed in fuel communication with a fuel rail 106 with the help of a supply line 108, one supply line 108*a*-108*d* for corresponding ones of the fuel injectors 104*a*-104*d*. A pump 110 located upstream of the fuel rail 106 is configured to draw fuel from a tank 112 via a suction line 111. The pump 110 pressurizes the fuel drawn within and supplies the pressurized fuel into the fuel rail 106. From the fuel rail 106, fuel is supplied, independently and selectively, to each of the fuel injectors 104*a*-104*d* via corresponding ones of the supply lines 108*a*-108*d* respectively.

Figure 2:
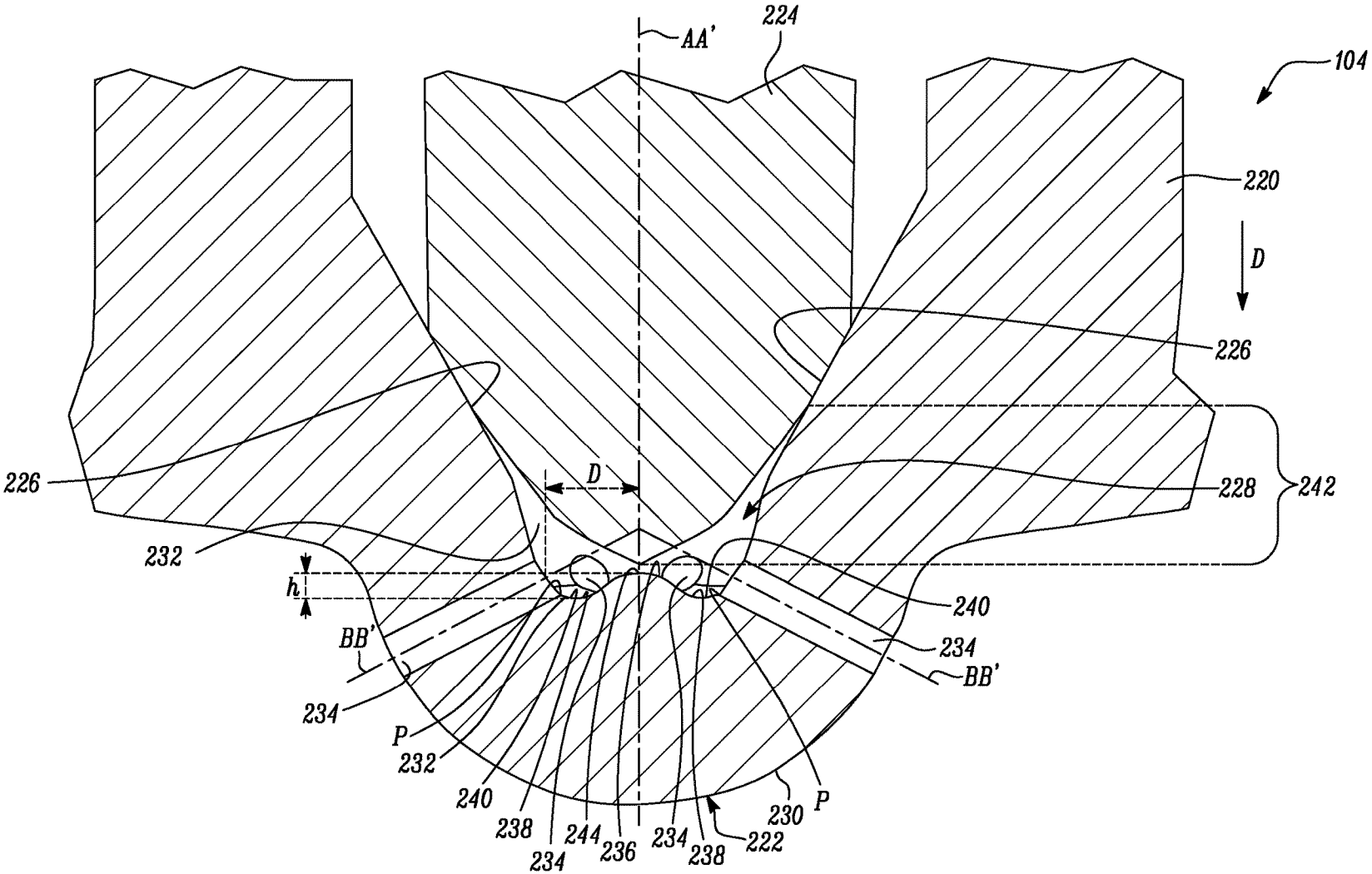
FIG. 2 is a sectional view of the fuel injector showing an injector tip, in accordance with an embodiment of the present disclosure.

FIG. 2 illustrates a sectional view of the fuel injector 104, in accordance with an embodiment of the present disclosure. As shown, the fuel injector 104 includes a body 220 having an injector tip 222. The fuel injector 104 also includes a needle 224 disposed within the body 220. The needle 224 is configured to operatively move in relation to a valve seat 226 defined by the body 220 for permitting fuel to flow downstream of the valve seat 226 and into a sac region 228 of the injector 104.

As shown, the injector tip 222 includes an exterior surface 230, and an interior surface 232 defining the sac region 228 therein. The injector tip 222 is also configured to define at least one orifice 234 radially extending from the interior surface 232 to the exterior surface 230. For example, the injector tip 222 shown in the illustrated embodiment of FIG. 2 is configured to define six orifices of which four orifices 234 are visible in the cross-sectional view of FIG. 2. Each orifice 234 is disposed in communication with the sac region 228 located adjacent to the interior surface 232.

Further, the injector tip 222 also includes a mound 236 that is defined on the interior surface 232. As shown, the mound 236 is convex in shape. In embodiments of this disclosure, it may be noted that the mound 236 is integrally formed with the interior surface 232 adjacent to the sac region 228. As shown, the mound 236 is configured to extend along an axis AA' of the sac region 228.

In the illustrated embodiment of FIG. 2, the mound 236 is configured to terminate prior to a perimeter P of the orifices 234. That is, ends 238 of the mound 236 are configured to end partway along a distance D between the axis AA' and each orifice 234 to tangentially merge with the interior surface 232 of the injector tip 222. Moreover, in this embodiment, the interior surface 232 also has a concave annular ridge 240 defined between ends 238 of the mound 236 and each orifice 234.

However, in other embodiments, the ends 238 of the mound 236 may be configured to terminate tangentially with the perimeter P of each orifice 234. That is, the ends 238 of the mound 236 could be disposed on a smallest locus of points subtended from the axis AA' on the interior surface 232 and coinciding with the perimeters P of the orifices 234. Further, although it is shown in the illustrated embodiment of FIG. 2 that an apex 244 of the mound 236 coincides with the axis AA' of the sac region 228, in other embodiments, the apex 244 may be offset from the axis AA'. For instance, if the axis BB' of each orifice 234 is not equiangular with respect to the axis AA', then it can be contemplated to define the mound 236 such that the apex 244 of the mound 236 is offset from the axis AA'. It may be noted that the amount of offset between the apex 244 of the mound 236 and the axis AA' of the sac region 228 may vary depending on specific requirements of an application.

Since the mound 236 protrudes into the sac region 228, the sac region 228 is rendered with a reduced volume. This reduced volume of the sac region 228 helps obviate a presence of excess fuel in the sac region 228 during and upon completion of a fuel discharge event by the fuel injector 104 into the combustion chamber 102. In fact, with the help of embodiments disclosed herein, it is envisioned that the mound 236 can be configured to help ensure that the sac region 228 is devoid of excess fuel during receipt, containment, and upon discharge of fuel from the sac region 228 of the fuel injector 104 into the combustion chamber 102 via the orifices 234 when the needle 224 travels towards the valve seat 226 (in a direction D as shown in FIG. 2) and co-operates with the mound 236 for delivering fuel into the sac region 228 and discharging fuel out of the sac region 228 into the combustion chamber 102 via the orifices 234. This way, the mound 236 contributes, at least in part, to an optimization in the metering of fuel before it is discharged into the combustion chamber 102 and therefore, minimizes the possibility of any fuel, excess or otherwise, from residing back in the sac region 228 and dribbling into the combustion chamber 102 during or after the fuel discharge event.

In the illustrated embodiment of FIG. 2, the needle 224 includes an end portion 242 that is configured to co-operate with the mound 236. This end portion 242 is convex in shape. Although a convex shape of this end portion 242 is disclosed herein, other shapes such as a flattened shape, or a concave shape may be used in lieu of the convex shape disclosed herein. It may be noted that the shape of the end portion 242 of the needle 224 may be varied to suit various requirements of a fuel-injection application including, but not limited to, a shape and/or size of the mound 236, a volume of the sac region 228 that would be required to optimize the metering of fuel contained within the sac region 228 during receipt, containment, and discharge of fuel by the sac region 228, an amount of time associated with movement of the needle 224 in relation to the valve seat 226 for permitting fuel into and discharging fuel out of the sac region 228 via the orifices 234 into the combustion chamber 102.

Figure 3:
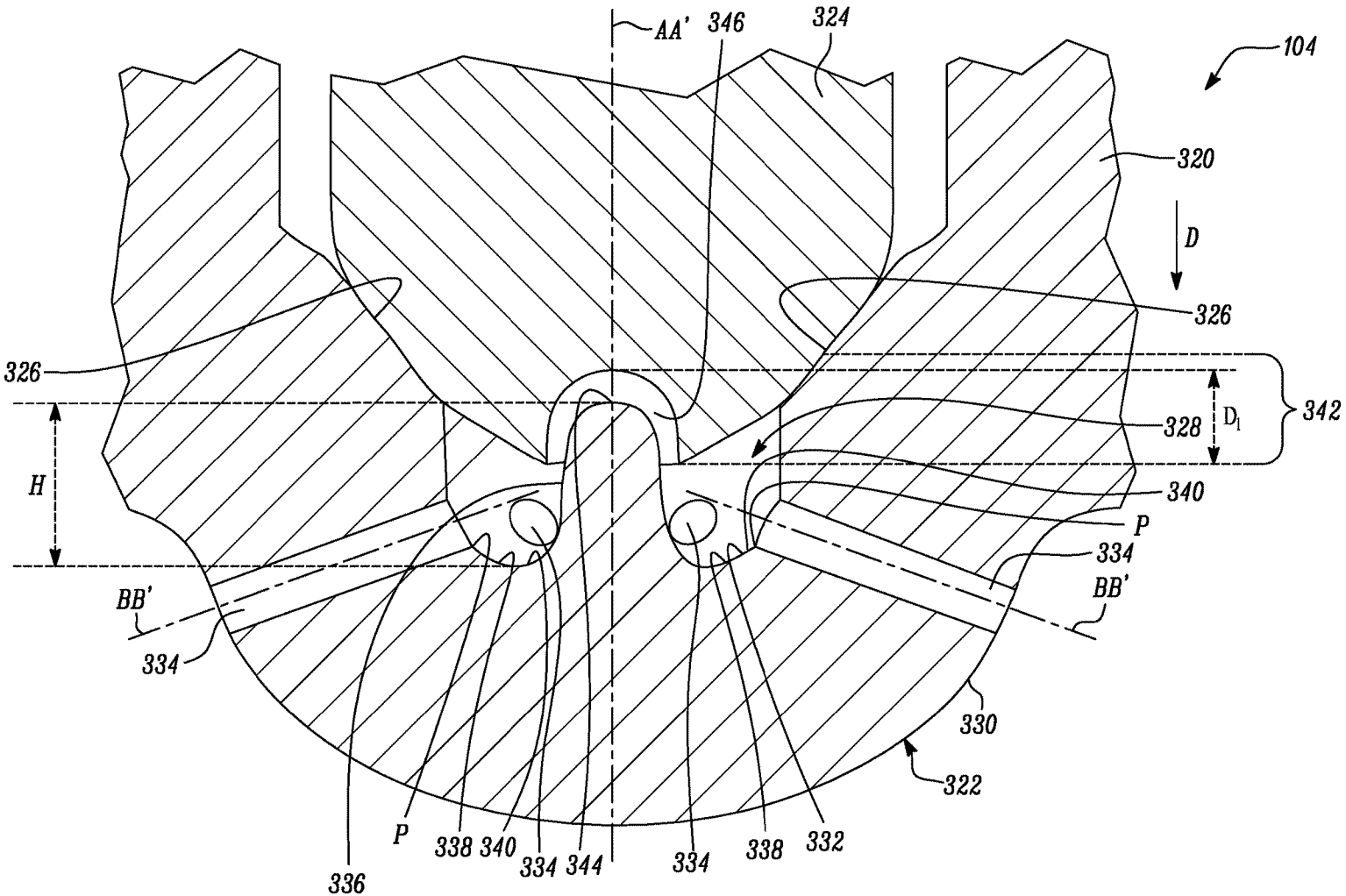
FIG. 3 is a sectional view of the fuel injector showing an injector tip, in accordance with another embodiment of the present disclosure.
Figure 4:
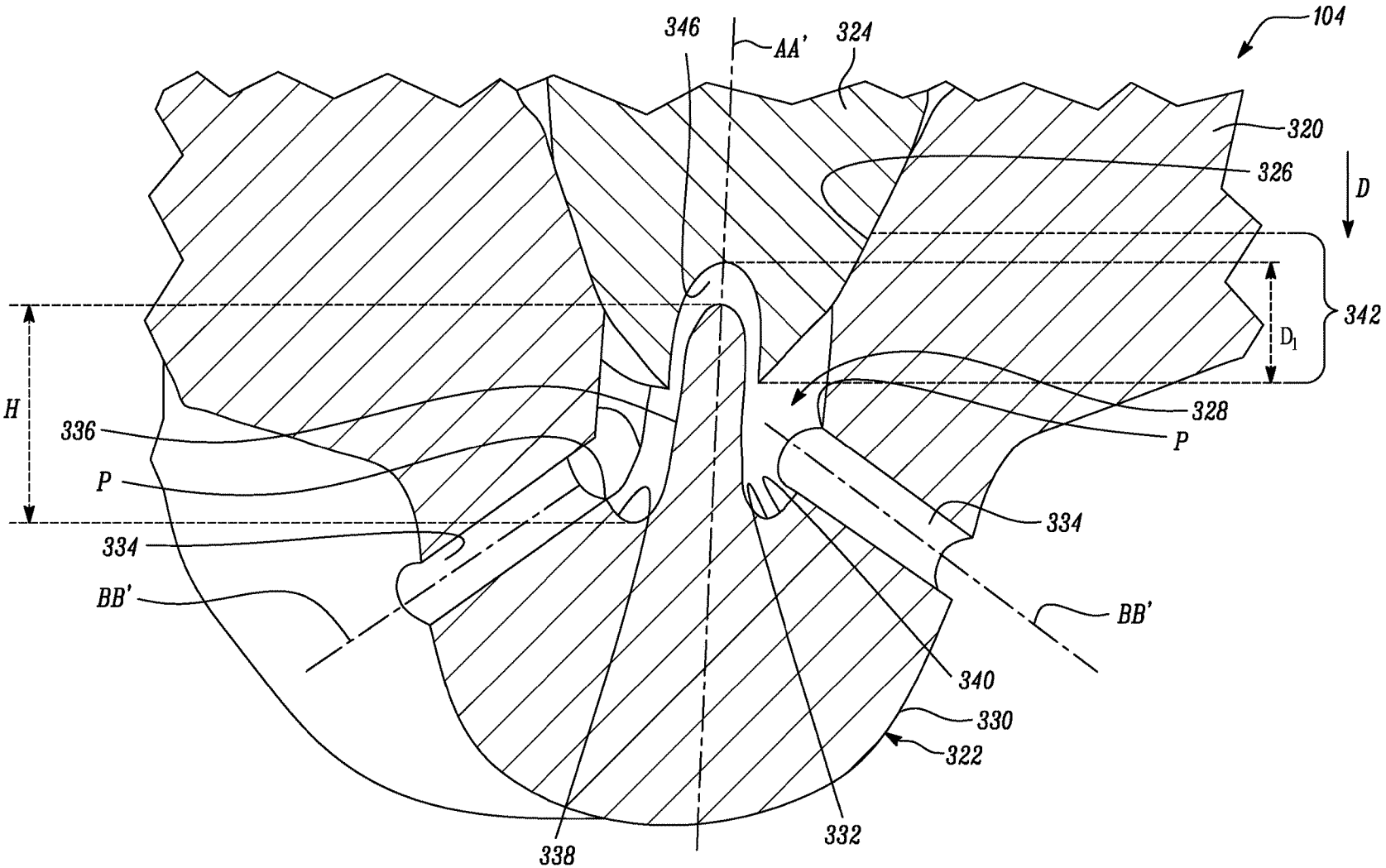
FIG. 4 is a sectional view of the fuel injector from FIG. 3 shown in another perspective.

FIGS. 3-4 illustrate sectional and perspective sectional views of the fuel injector 104 having an injector body 320 and showing an injector tip 322 in accordance with another embodiment of the present disclosure. Referring to FIGS. 3-4, a mound 336 is defined on and integrally formed with an interior surface 332 of the injector tip 322. As shown, the mound 336 extends along an axis AA' of the sac region 328 with ends 338 of the mound 336 terminating prior to a perimeter P of each orifice 334.

Moreover, in this embodiment, the mound 336 extends substantially to a height H along axis AA'. For sake of the present disclosure, this height H of the mound 336 may be regarded as being greater than a height h associated with the mound 236 shown in the illustrated embodiment of FIG. 2. As shown in this embodiment, the end portion 342 of the needle 324 is configured to define a concave recess 346 corresponding in shape to the elongated convex shape of the mound 336. Further, a depth $D_1$ of the concave recess 346 may be selected, depending on specific requirements of a fuel-injection application as disclosed earlier herein, to correspond with the height H of the mound 336 in that the concave recess 346 may not receive, at least partially receive, or fully receive the mound 336 therein when the needle 324 is in abutment with a valve seat 326 defined by an injector body 320. For instance, in the illustrated embodiment of FIGS. 3-4, the depth $D_1$ of the concave recess 346 is less than the height H of the mound 336 and the concave recess 336 is therefore, configured to partially receive the mound 336 therein when the needle 324 is in abutment with the valve seat 326.

In embodiments herein, it may be noted that the mounds 236/336 are also configured to impart additional strength to the injector tip 222/322 as these mounds 236/336 are integrally formed with interior surfaces 232/332 of corresponding ones of the injector tips 222/322 disclosed herein. Various processes including, but not limited to, end milling, 3D printing, or any other material removal or material additive processes known to persons skilled in the art are contemplated for forming the mounds 236/336 integrally with the interior surfaces 232/332 of corresponding ones of the injector tips 222/322 respectively.

Also, when forming the mounds 236/336 disclosed herein, ends 238/338 of corresponding mounds 236/336 may be configured to, optionally, terminate at regions of the interior surfaces 232/332 between successive ones of corresponding orifices 238/338. These regions may be located on a locus of points that are different from that where the ends 238/338 of the mounds 236/336 terminate prior to, or tangentially with the perimeters $P/P_1$ of the corresponding orifices 234/334. The ends 238/338 of the mounds 236/336 at these regions may be contoured with corresponding ones of the interior surfaces 232/332 itself so that these ends 238/338 of the corresponding mounds 236/336 can help improve a flow of fuel from the orifices 234/334 of corresponding ones of the injector tips 222/322 into the combustion chamber 102.

Various embodiments disclosed herein are to be taken in the illustrative and explanatory sense, and should in no way be construed as limiting of the present disclosure. All joinder references (e.g., connected, coupled and the like) are only used to aid the reader's understanding of the present disclosure, and may not create limitations, particularly as to the position, orientation, or use of the systems and/or methods disclosed herein. Therefore, joinder references, if any, are to be construed broadly. Moreover, such joinder references do not necessarily infer that two elements are directly connected to each other.

Additionally, all numerical terms, such as, but not limited to, "first", "second", or any other ordinary and/or numerical terms, should also be taken only as identifiers, to assist the reader's understanding of the various elements, embodiments, variations and/or modifications of the present disclosure, and may not create any limitations, particularly as to the order, or preference, of any element, embodiment, variation and/or modification relative to or over another element, embodiment, variation and/or modification.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

Embodiments of the present disclosure have applicability for use and implementation in reducing fuel dribble out of fuel injectors and into combustion chambers of engines during fuel-injection events. With implementation of the injector tips 222/322 disclosed herein, manufacturers and users of engines can improve a quality of emissions released from an engine. A reduced level of unburned hydrocarbons (UHC) could be present in the released emissions that would otherwise increase if fuel-dribble occurred from the injectors into the combustion chamber/s of an engine.

In many countries, efforts have been made to regulate the quality of emissions with the help of various emissions norms that mandate the level of UHC permitted in a predetermined amount of emissions released by an engine. With use of embodiments disclosed herein, manufacturers can improve an overall performance of engines in terms of emission quality while, optionally or additionally, helping the engines to reduce fuel consumption for improving fuel mileage as the injector tips 222/322 of the present disclosure define sac regions 228/328 that are rendered with a reduced volume as opposed to a volume associated with previously known configurations of conventional sac regions.

Additionally, with inclusion of the mound 236/336, additional strength may be imparted to corresponding ones of the injector tips 222/322 thereby improving a service life and reliability of the injector tips 222/322 in withstanding extreme forces encountered during operation. Therefore, use of the injector tips 222/322 may also reduce costs, time, and effort typically incurred with frequent service of conventionally configured fuel injector tips and/or replacement of previously known fuel injectors.

While aspects of the present disclosure have been particularly shown and described with reference to the embodiments above, it will be understood by those skilled in the art that various additional embodiments may be contemplated by the modification of the disclosed machines, systems, methods and processes without departing from the spirit and scope of what is disclosed. Such embodiments should be understood to fall within the scope of the present disclosure as determined based upon the claims and any equivalents thereof.

What is claimed is:

1. An injector tip for a fuel injector, the injector tip comprising:

a movable needle;

an exterior surface, and an interior surface defining a sac region therein;

a plurality of orifices, each said orifice extending radially outward extending from an inlet opening thereof at the interior surface to an outlet opening thereof at the exterior surface and being disposed in communication with the sac region located adjacent to the interior surface; and a single mound defined on the interior surface, the mound extending from a center axis of the sac region and terminating prior to an inner perimeter at the inlet opening of each said orifice, wherein the mound is integrally formed with the interior surface adjacent to the sac region so as to define a surface profile in a side sectional view of the injector tip that is continuously curved from an annular upper and outer edge of the sac region to the mound at the center axis of the sac region, and that converges radially inward at all times from the annular upper and outer edge of the sac region to the mound, wherein a portion of the mound is above the inner perimeter at the inlet opening of each said orifice in the side sectional view of the injector tip, and wherein the movable needle is convex at an end portion thereof and movable in the sac region such that:

in a lower-most position the movable needle contacts the interior surface at the annular upper and outer edge of the sac region and a bottom-most tip of the movable needle is provided in non-overlapping fashion relative to the mound at the center axis of the sac region, and in an upper-most position no portion of the movable needle contacts the interior surface.

2. The injector tip of claim 1 further comprising a concave ridge portion disposed between the mound and each said orifice.

3. The injector tip of claim 1, wherein the mound is convex in shape.

4. The injector tip of claim 1, wherein the portion of the mound includes an apex of the mound, the apex of the mound being above an outer perimeter at the inlet opening of each said orifice in the side sectional view of the injector tip.

5. A fuel injector for an engine, the fuel injector comprising:

a body having:

an injector tip having:

an exterior surface, and an interior surface defining a sac region therein;

a plurality of orifices, each said orifice extending radially outward from an inlet opening thereof at the interior surface to an outlet opening thereof at the exterior surface and being disposed in communication with the sac region located adjacent to the interior surface; and a single mound defined on the interior surface, the mound extending from a center axis of the sac region and terminating prior to an inner perimeter at the inlet opening of each said orifice, wherein the mound is integrally formed with the interior surface adjacent to the sac region so as to define a surface profile in a side sectional view of the injector tip that is continuously curved from an annular upper and outer edge of the sac region to the mound at the center axis of the sac region, and that converges radially inward at all times from the annular upper and outer edge of the sac region to the mound; and a needle disposed within the body, wherein an end portion of the needle is configured to co-operate with the mound to direct a flow of fuel into each said orifice, wherein a portion of the mound is above the inner perimeter at the inlet opening of each said orifice in the side sectional view of the injector tip, and wherein the needle is movable in the sac region such that:

in a lower-most position the needle contacts the interior surface at the annular upper and outer edge of the sac region, and in an upper-most position no portion of the needle contacts the interior surface.

6. The fuel injector of claim 5, wherein the end portion of the needle is disposed at the center axis of the sac region.

7. The fuel injector of claim 5, wherein the end portion of the needle is configured to define a concave recess corresponding in shape to a shape of the mound.

8. The fuel injector of claim 5, wherein the injector tip comprises a concave ridge portion disposed between the mound and each said orifice.

9. The fuel injector of claim 5, wherein the mound is convex in shape.

10. The fuel injector of claim 5, wherein the portion of the mound includes an apex of the mound, the apex of the mound being above an outer perimeter at the inlet opening of each said orifice in the side sectional view of the injector tip.

11. An engine comprising:

a combustion chamber;

a fuel injector partially received in the combustion chamber to deliver a pressurized supply of fuel, the fuel injector having:

a body having:

an injector tip having:

an exterior surface, and an interior surface defining a sac region therein;

a plurality of orifices, each said orifice extending radially outward from an inlet opening thereof at the interior surface to an outlet opening thereof at the exterior surface and being disposed in communication with the sac region located adjacent to the interior surface; and a mound defined on the interior surface, the mound extending from a center axis of the sac region and terminating prior to an inner perimeter at the inlet opening of each said orifice, wherein the mound is integrally formed with the interior surface adjacent to the sac region so as to define a surface profile in a side sectional view of the injector tip that is continuously curved from an annular upper and outer edge of the sac region to the mound at the center axis of the sac region, and that converges radially inward at all times from the annular upper and outer edge of the sac region to the mound; and a needle disposed within the body, wherein an end portion of the needle is configured to co-operate with the mound to direct a flow of fuel into each said orifice, wherein an apex of the mound extends into the sac region to a first height above a second height of the inner perimeter at the inlet opening of each said orifice, and wherein the needle is movable in the sac region such that:

in a lower-most position the needle contacts the interior surface at the annular upper and outer edge of the sac region, and in an upper-most position no portion of the needle contacts the interior surface.

12. The engine of claim 11, wherein the end portion of the needle is disposed at the center axis of the sac region.

13. The engine of claim 11, wherein the end portion of the needle is configured to define a concave recess corresponding in shape to a shape of the mound, the concave recess disposed about the center axis of the sac region.

14. The engine of claim 11, wherein the injector tip comprises a concave ridge portion disposed between the mound and each said orifice.

15. The engine of claim 11, wherein the mound is convex in shape.

16. The engine of claim 11, wherein the engine is a direct gas injection engine.

* * * * *